US006575784B1

(12) United States Patent
Yamada

(10) Patent No.: US 6,575,784 B1
(45) Date of Patent: Jun. 10, 2003

(54) CONNECTOR FOR A SHIELDED WIRE

(75) Inventor: Yasuyuki Yamada, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/559,188

(22) Filed: Apr. 27, 2000

(30) Foreign Application Priority Data

Apr. 27, 1999 (JP) ..... 11-120213

(51) Int. Cl.[7] ..... H01R 9/05
(52) U.S. Cl. ..... 439/578; 439/583; 439/585
(58) Field of Search ..... 439/578, 583, 439/584, 585, 579, 580–582

(56) References Cited

U.S. PATENT DOCUMENTS 3,573,712 A * 4/1971 Shirey ..... 439/584
5,269,701 A * 12/1993 Leibfried, Jr. ..... 439/578
6,123,567 A * 9/2000 McCarthy ..... 439/584

FOREIGN PATENT DOCUMENTS

| | | |
|---|---|---|
| DE | 94 00 943.0 | 4/1994 |
| DE | 195 28 234 A1 | 2/1997 |
| EP | 0 077 246 | 4/1983 |
| GB | 2 277 207 A | 10/1994 |

* cited by examiner

*Primary Examiner*—Renee Luebke
*Assistant Examiner*—Ann McCamey
(74) *Attorney, Agent, or Firm*—Sughrue Mion, PLLC

(57) ABSTRACT

A connector (10) includes a cylindrical main body (20) which can be inserted between a braided conducting shield (63) and an insulating sheath (64) of a shielded wire (60) in the longitudinal direction thereof, a connection portion (30) provided at the base end portion of the main body (20), and a main-body-diameter reducing mechanism (40) for reducing the diameter of the leading end portion of the main body (20).

7 Claims, 7 Drawing Sheets

CONNECTOR FOR A SHIELDED WIRE

BACKGROUND OF THE INVENTION

1. Field of the Invention

The present invention relates to a connector for a shielded wire. More particularly, the present invention relates to a connector capable of facilitating processing of an end portion of a shielded wire.

The present application is based on Japanese Patent Application No. Hei. 11-120213, which is incorporated herein by reference.

2. Description of the Related Art

As shown in FIGS. 6 and 7, a shielded wire 60 comprises a conductor 61, an insulating layer 62 for coating the conductor 61, a braided conducting shield 63 for covering the insulating layer 62, and an insulating sheath 64 for covering the braided conducting shield 63.

A related connector 70, connected to an end portion of the shielded wire 60, comprises a cylindrical main body 71, a connection portion 72 formed at one end portion of the main body 71 (the left side of FIGS. 6 and 7), a clamp 73 to be inserted into the main body 71 from the other side thereof (i.e., the right side of the main body 71), a gasket 74, a washer 75, and a clamp 76.

The main body 71 is made of an appropriate metal capable of establishing conduction with the braided conducting shield 63, and a rib 77 is formed along the interior circumferential surface of the main body 71 so as to extend in the radial direction. Further, an insulating sleeve 78 is provided between the rib 77 and the connection portion 72.

The connection portion 72 is formed into a cylindrical shape, is concentrically rotatable relatively to the main body 71, and is to be connected to a connection portion of another connector or that of predetermined equipment, by way of a female thread 79 formed along the interior circumferential surface of the connection portion 72.

The clamp 73 is formed into a stepped cylindrical shape, and each of the gasket 74 and the washer 75 is essentially formed into a disk-like shape of predetermined thickness. The clamp 73, the gasket 74, and the washer 75 are retained within the main body 71 while being stacked, by screw-engaging the substantially-cylindrical outer peripheral surface of the clamp 76 with the interior surface of the main body 71.

In order to connect the end portion of the shielded wire 60 to the connector 70, the conductor 61 is exposed a predetermined length in advance from the shielded wire 60, and then a center contact 65 is soldered to the exposed end portion of the conductor 61. Further, the shielded wire 60 is axially passed through the clamp 73, the gasket 74, and the washer 75.

Next, the braided conducting shield 63 is folded back such that the insulating layer 62 is exposed a predetermined length, and the clamp 73 is interposed between the leading end portion of the braided conducting shield 63 and the insulating sheath 64 as shown in FIG. 6.

Finally, the center contact 65 is axially inserted into the insulating sleeve 78 from one end portion of the main body 71, to thereby protrude from the connection portion 72. Further, the clamp 76 is screw-engaged with the main body 71, wherewith the end portion of the shielded wire 60 is fixedly pressed into the main body 71 by way of the clamp 73, the gasket 74, and the washer 75 such that the end portion of the insulating layer 62 and a folded-back portion 66 of the braided conducting shield 63 abut against a rib 77 of the main body 71, thereby connecting the end portion of the shielded wire 60 with the connector 70 as shown in FIG. 7.

In the meantime, connecting the connector 70 with the shielded wire 60 may involve a troublesome operation, because it is necessary to complicatedly treat the end portion of the shielded wire 60 after axially inserting in advance the end portion of the shielded wire 60 into the clamp 73, the gasket 74, the washer 75, and the clamp 76, and further, it is necessary to fixedly press the end portion of the shielded wire 60 into the main body 71 by way of a plurality of components.

In particular, the connector 70 is usually shipped and transported after individual components of the connector 70 are assembled into a single assembly. However, when the connector 70 is connected to the end portion of the shielded wire 60, the connector 70 has to be re-assembled after having been disassembled into individual components. Accordingly, double assembling operations are needed.

Further, since the connector 70 requires many components of comparatively high precision, a high manufacturing cost may be required.

SUMMARY OF THE INVENTION

The present invention has been conceived in light of the foregoing drawbacks. An object of the present invention is to provide a connector simplifying treatment of the end portion of a shielded wire and reducing the number of components.

To achieve the above object, according to the first aspect of the present invention, there is provided a connector connectable to an end portion of a shielded wire which includes a conductor, an insulating layer coating the conductor, a braided conducting shield covering the insulating layer, and an insulating sheath covering the braided conducting shield, the connector allowing axial insertion of the conductor of the shielded wire while insulating the conductor, the connector comprising a cylindrical main body insertable between the braided conducting shield and the insulating sheath in a longitudinal direction of the shielded wire so as to electrically connect to the braided conducting shield, a connection portion provided at a base end portion of the main body in an inserting direction in which the main body is inserted between the braided conducting shield and the insulating sheath, and a main-body-diameter reducing mechanism for reducing a diameter of a leading end portion of the main body in the inserting direction thereof.

Herein, as the structure of the main body for ensuring conduction with the braided conducting shield and insulation of the conductor, there may be employed a structure for causing a conductor to axially pass through the main body without involving a contact with the main body by setting the minimum internal diameter of the main body to be greater than the external diameter of the conductor, or a structure for causing a conductor to axially pass through the main body by setting the internal diameter of the main body to be greater than the diameter of the insulating layer.

There may also be employed a structure for fitting the insulating sleeve along the interior circumferential surface of an insertion hole through which the conductor is axially passed.

In the connector having the foregoing structure, the diameter of the main body inserted between the braided conducting shield and the insulating sheath is reduced, and therefore, the main body holds the braided conducting shield. Accordingly the connector can be connected with the end portion of the shielded wire.

More specifically, the connector of the present invention eliminates the necessity of complicated preliminary operations, which would have been required by the related connector. In contrast with the related connector, the connector of the present invention can reduce the number of components, and does not require a high precision to the components.

Accordingly, in comparison with the related connector, the connector of the present invention can simplify the operations required for connecting the end portion of the shielded wire to the braided-shield connector, and therefore, the manufacturing costs are reduced.

Further, according to the second aspect of the present invention, it is preferable that the main-body-diameter reducing mechanism includes at least one main body slit formed in the main body so as to extend from the leading end portion of the main body to a predetermined position in a longitudinal direction of the main body, and a main body nut formed on an exterior surface of the main body, and wherein the main body and the main body nut are brought into contact with each other by way of either a truncated-cone surface or a tapered surface which is tapered in a vicinity of an end portion of the main body slit toward the leading end portion of the main body in the inserting direction thereof.

The main body slit may correspond to a slit which is formed into a linear, curved, or helical shape in the longitudinal direction of the main body. The number of main body slits is arbitrary.

In a case where a plurality of main body slits are formed in the main body, for example, the slits may be formed so as to originate from positions along the generating line of the main body, wherein the positions are centered on the axis of the main body and spaced uniform intervals apart from one another in a circumferential direction.

Further, the truncated-cone surface may be formed such that the end portion of the main body slit of the main body serves as a large-diameter portion.

On one hand, the tapered surface may be formed so as to be tapered from one end portion to the other end portion of the main body nut on the interior circumferential surface of the main body nut.

Either the truncated-cone surface or the tapered surface or both of them may be employed as the main-body-diameter reducing mechanism.

In a case where both the truncated-cone surface and the tapered surface are used in combination as the main-body-diameter reducing mechanism, there is no necessity of bringing the truncated-cone surface into surface contact with the tapered surface. The truncated-cone surface may be brought into contact with the main body independently of the tapered surface being brought into contact with the main body nut.

The connector having the foregoing structure employs the main-body-diameter reducing mechanism for bringing the main body into contact with the main body nut by way of the truncated-cone surface and the tapered surface. Therefore, the diameter of the leading end portion of the main body is reduced by screwing the main body nut relative to the main body while the width of the main body slit is reduced.

Namely, in the connector, the main body and the main body nut, the main body readily and firmly holds the braided conducting shield through extremely simple operations; that is, screw-engagement of the main body nut with the main body. Accordingly, the connector can be connected to the end portion of the shielded wire. In the connector, the diameter of the main body can be reduced in a stepless manner by screw-engagement of the main body with the main body nut, thereby offering versatility to braided conducting shields of different diameters.

Further, according to the third aspect of the present invention, it is preferable that an interior circumferential surface of the main body is formed into a stepped geometry including a large-diameter portion and a small-diameter portion, an end surface of the braided conducting shield can abut against a stepped surface between the large-diameter portion and the small-diameter portion, and an insulating sleeve is fitted around the small-diameter portion.

In the connector, the end surface of the braided conducting shield can abut against a stepped surface, thereby limiting the position of the main body relative to the shielded wire. Thus, there can be obviated the chance of the main body endlessly entering the space between the braided conducting shield and the insulating sheath.

In the connector, the insulating sleeve is fitted around the small-diameter portion, and therefore, the conductor can be unfailingly insulated from the main body.

Further, according to the fourth aspect of the present invention, it is preferable that the main body has a cross section longitudinally tapered toward the leading end portion of the main body in the inserting direction thereof.

Herein, the main body may be provided with both or either an interior tapered surface which originates from a predetermined position on the interior circumferential surface of the main body and spreads toward the leading end portion of the main body in the inserting direction thereof, or a cone-shaped exterior tapered surface which originates from a predetermined position on the exterior surface of the main body and is oriented toward the leading end portion of the main body in the inserting direction thereof.

In the connector, since the main body has a tapered cross section, the main body can be readily inserted into the space defined between the braided conducting shield and the insulating sheath, thereby facilitating an operation required for connecting the connector with the shielded wire. There can be reduced the chance of the end surface of the braided conducting shield and that of the insulating sheath being damaged.

Next, according to the fifth aspect of the present invention, the connector may further comprises an engagement mechanism for causing the main body to engage in an exterior circumferential surface of the insulating sheath, wherein the engagement mechanism includes a cylinder portion which is connected to the main body nut and extends along the exterior circumferential surface of the insulating sheath, a claw formed on an interior circumferential surface of the cylinder portion at an open end portion of the cylinder portion, and a cylinder-portion-diameter reducing mechanism which reduces a diameter of the open end portion of the cylinder portion.

Herein, the claw may be formed into a rib-like shape, a chevron-like cross sectional shape, a pyramid-like cross sectional shape, a cone-like cross sectional shape, a spherical cross sectional shape, or the like.

As in the case of the main-body-diameter reducing mechanism, there may be employed, as a cylinder-portion-diameter reducing mechanism, a structure embodied by forming slit in a cylinder portion in the longitudinal direction thereof, and causing an appropriate engagement member to screw-engage with the exterior surface of the base end portion of the cylinder portion in the inserting direction thereof, by way of the truncated-cone surface or tapered surface.

In the connector, when the diameter of the cylinder portion is reduced by the cylinder-portion-diameter reducing mechanism, the claw formed on the cylinder portion is brought into engagement in the exterior circumferential surface of the insulating sheath by way of the cylinder portion and the main body nut, thereby ensuring the relative position of the main body with respect to the insulating sheath.

Namely, in the connector, the position of the main body relative to the shielded wire can be maintained, thereby enabling unfailing connection of the main body with the end portion of the shielded wire.

Further, according to the sixth aspect of the present invention, the cylinder-portion-diameter reducing mechanism may include a cylinder slit formed in the cylinder portion so as to extend in a longitudinal direction thereof, and a cylinder nut to be screw-engaged with an outside of the main body nut, wherein the main body and the main body nut are brought into contact with each other by way of either a truncated-cone surface or a tapered surface, which is tapered in the vicinity of the end portion of the main body slit toward the leading end portion of the main body in the inserting direction thereof.

Herein, as in the case of the main body slit, the cylinder slit may correspond to a slit which is formed in a linear, curved, or helical shape in the longitudinal direction of the main body. The number of main body slits is arbitrary.

As in the case of the main-body-diameter reducing mechanism, the cylinder-portion-diameter reducing mechanism employs either a truncated-cone surface or a tapered surface or both.

Accordingly, in the connector, the main body can be readily, unfailingly engaged with the braided conducting shield through considerably simple operations; that is, screw-engagement of the nut of the cylinder portion with the main body nut. The diameter of the main body can be reduced in a stepless manner by screw-engagement of the cylinder portion nut with the main body nut, thus offering versatility to braided conducting shields having insulating sheathes of different diameters.

DETAILED DESCRIPTION OF THE PREFERRED EMBODIMENTS

Figure 6:
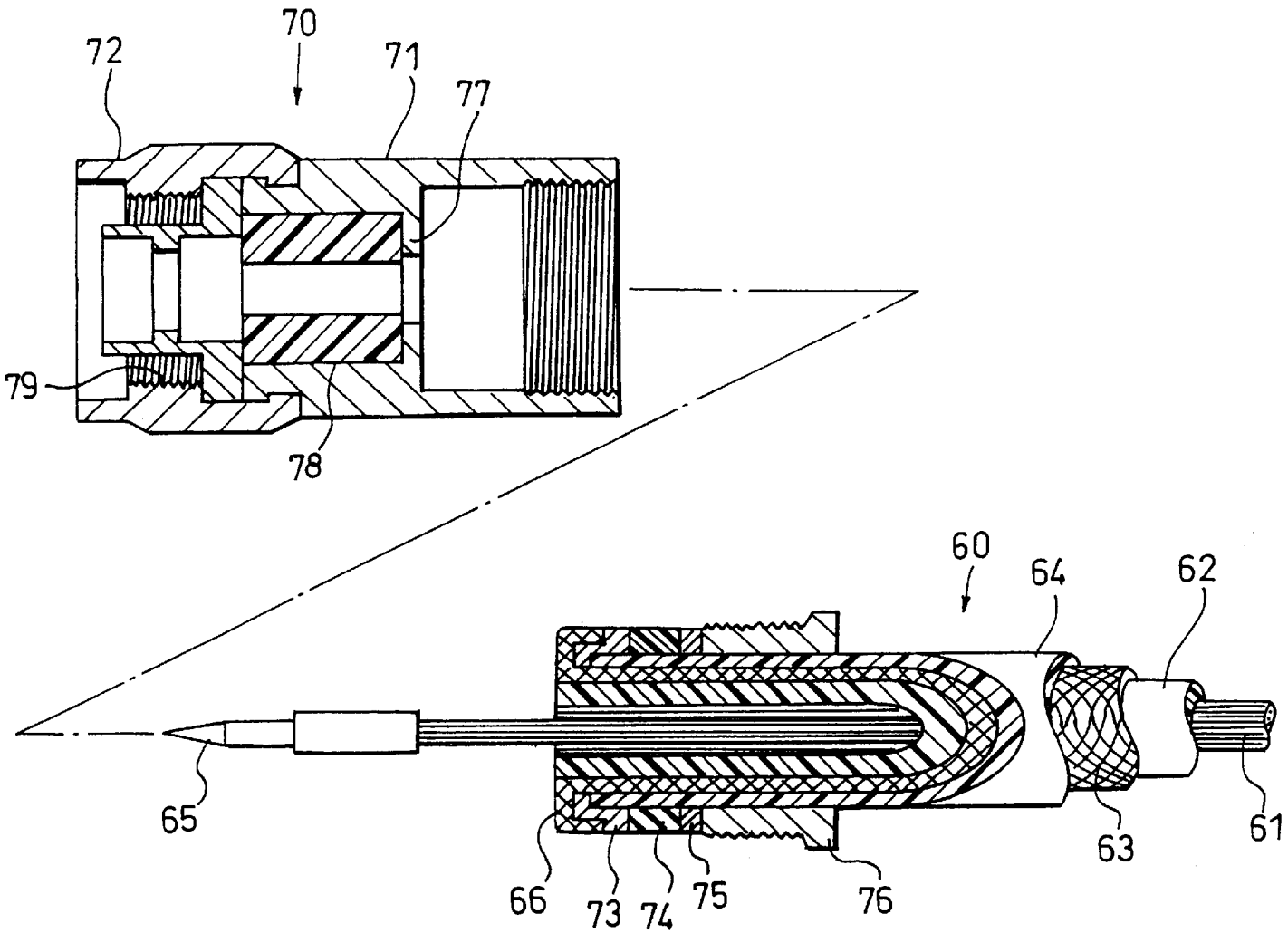
FIG. 6 PRIOR ART
FIG. 6 is an exploded cross-sectional view showing a related connector.
Figure 7:
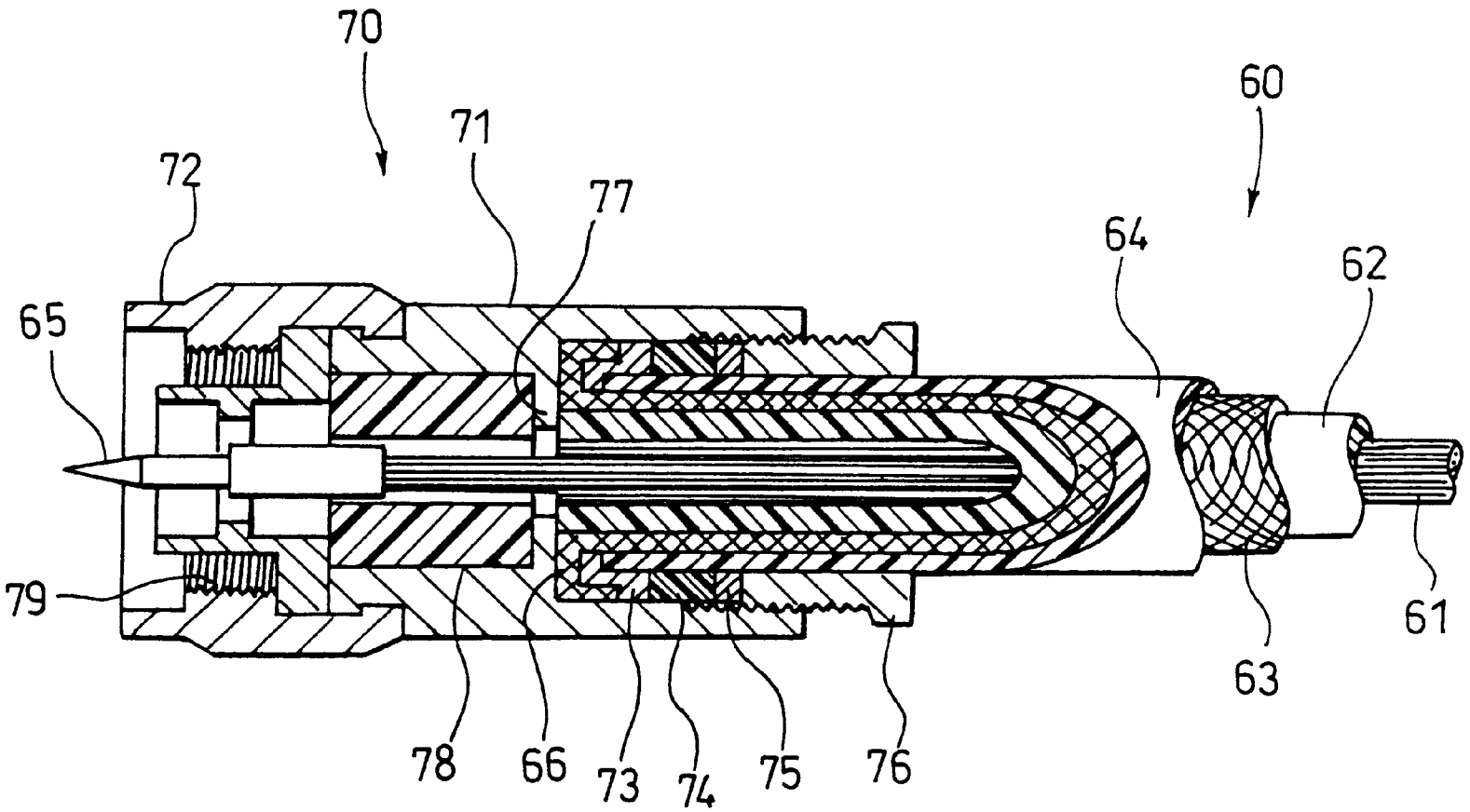
PRIOR ART FIG. 7
FIG. 7 is a cross-sectional view showing the related connector when it is assembled.

Preferred embodiments of the present invention will now be described in detail hereinbelow with reference to the accompanying drawings. In the embodiments to be described later, the components that have already been described in connection with FIGS. 6 and 7 are assigned the same or corresponding reference numerals, and repetition of their explanations is simplified or omitted.

Figure 1:
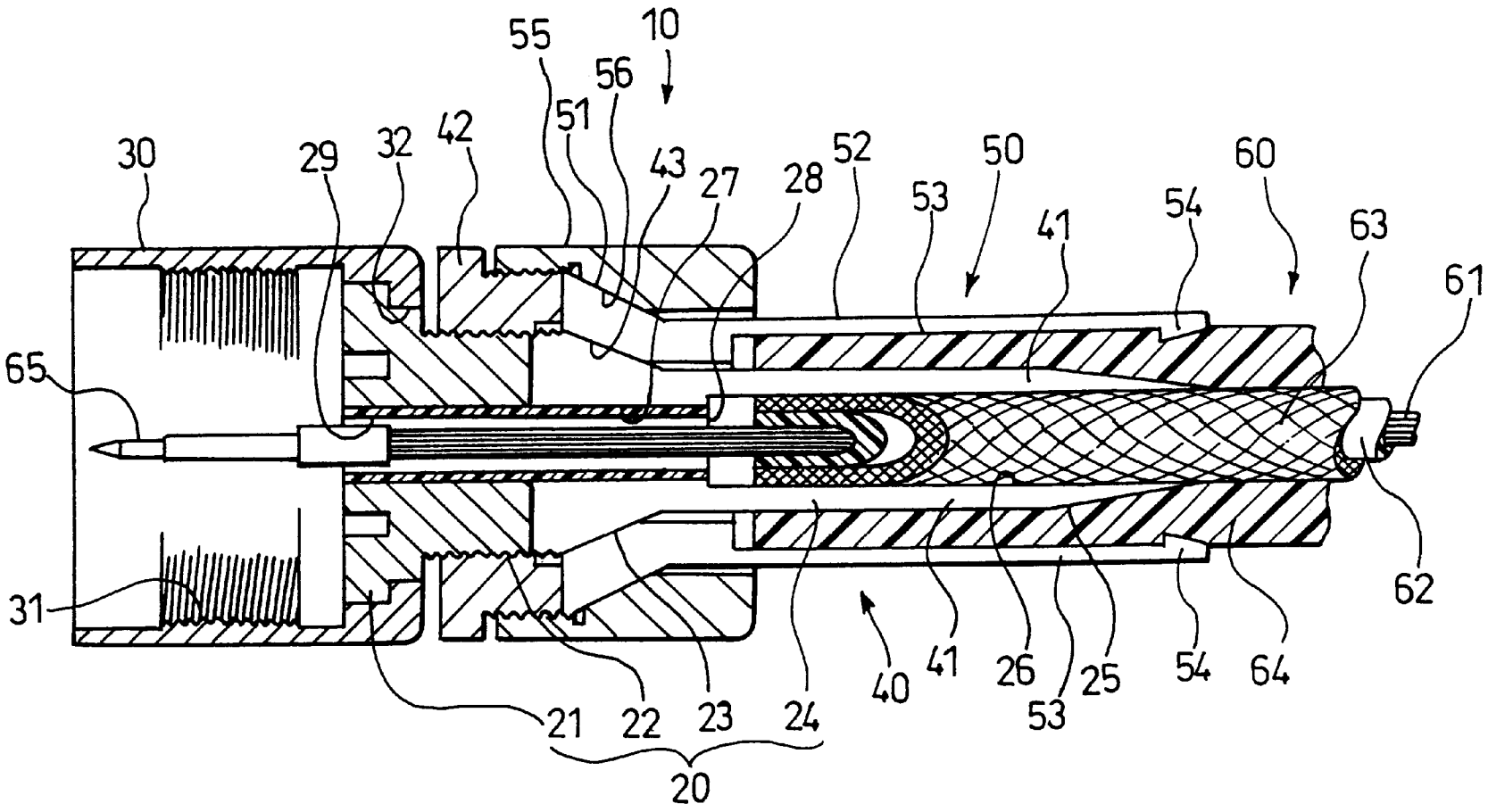
FIG. 1 is a cross-sectional view showing a connector according to a first embodiment of the present invention.
Figure 2:
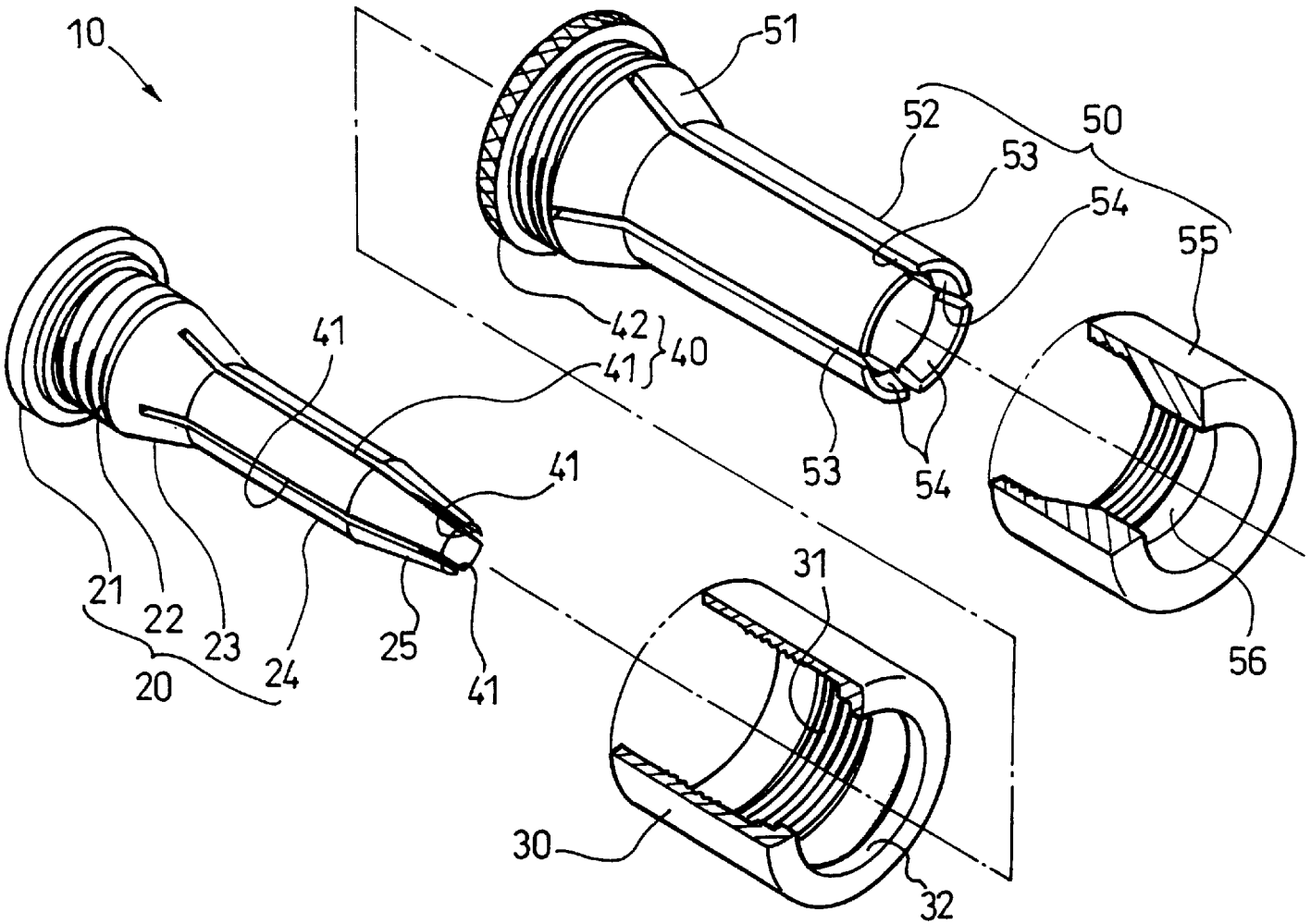
FIG. 2 is an exploded perspective view showing the connector shown in FIG. 1.

As shown in FIGS. 1 and 2, a connector 10 according to a first embodiment of the present invention comprises a cylindrical main body 20 which can be inserted between a braided conducting shield 63 and an insulating sheath 64 in the longitudinal direction of the shielded wire 60; a connection portion 30 provided at the base end portion of the main body 20 (i.e., the left side of the main body 20 in FIG. 1); a main-body-diameter reducing mechanism 40 for reducing the diameter of the leading end portion of the main body 20 (the right side of the main body 20 in FIG. 1); and an engagement mechanism 50 for causing the main body 20 to engage with the outer peripheral surface of the insulating sheath 64.

The main body 20 comprises a substantially-stepped disk-like flange 21; a cylindrical male screw 22 joined to the flange 21; a truncated-cone portion 23 joined to the male screw 22; and an insert portion 24 joined to the truncated-cone portion 23. The axis of the flange 21, that of the male screw 22, that of the truncated-cone portion 23, and that of the insert portion 24 are brought into alignment with one another.

A large-diameter portion of the truncated-cone portion 23 corresponds to the diameter of the male screw 22, whereas a small-diameter portion of the truncated-cone portion 23 corresponds to the diameter of the insert portion 24. The main body 20 is tapered toward the leading end portion.

An exterior tapered surface 25 is formed at a predetermined location on the exterior peripheral surface of the insert portion 24, so as to be tapered toward the leading end portion of the main body 20.

Accordingly, the insert portion 24 assumes a cross section tapered toward the leading end portion in the longitudinal direction of the main body 20.

The interior circumferential surface of the main body 20 is formed in a stepped manner that a large-diameter portion 26 and a small-diameter portion 27 continuously meet by way of a stepped surface 28. Hence, the interior surface of the main body 20 assumes a stepped geometry (see FIG. 1).

The internal diameter of the large-diameter portion 26 corresponds to the outer diameter of the braided conducting shield 63. This large-diameter portion 26 is continuously formed to a predetermined location from the leading end portion of the main body 20 along the axis thereof.

On one hand, the internal diameter of the small-diameter portion 27 corresponds to the outer diameter of an insulating layer 62. The small-diameter portion 27 is continuously formed from the stepped surface 28 to a predetermined length and to the base end portion of the main body 20 along the axis thereof. The internal diameter of the insulating sleeve 29 is set to be smaller than the outer diameter of the insulating layer 62, thus enabling insertion of only a conductor 61 into the insulating sleeve 29.

The main body 20 is made of appropriate metal establishing good conduction with respect to the braided conducting shield 63 and is formed integrally from the flange 21, the male screw 22, the truncated-cone portion 23, and the insert portion 24.

Since the internal diameter of the small-diameter portion 27 corresponds to the outer diameter of the insulating layer 62, the conductor 61 is electrically insulated from the main body 20 even if the insulating sleeve 29 is omitted, so long as the conductor 61 is inserted into the main body 20 while being sheathed by the insulating layer 62.

The connection portion 30 is formed into a substantially-cylindrical geometry, and a female thread 31 is formed on the interior peripheral surface of the connection portion 30. Further, an engagement rib 32 is formed at one axial end portion of the connection portion 30.

The connection portion 30 becomes coaxially rotatable relative to the main body 20 without being removed therefrom, by causing the engagement rib 32 to engage with the flange 21 of the main body 20. The connection portion 30 enables the connector 10 to connect with a connection portion of another connector or a connection portion of predetermined equipment, by way of the female thread 31.

The main-body-diameter reducing mechanism 40 is embodied by combination of a plurality of main-body slits 41 formed in the main body 20 and a main 15 body nut 42 to be screw-engaged with the male screw 22 formed on the main body 20.

The slits 41 originate from positions along the circumference of the leading end portion of the main body 20, the positions being centered on the axis of the main body 20 and spaced uniform intervals apart from one another in a circumferential direction. The slits 41-linearly extend from the positions to the large-diameter portion 26 of the truncated-cone portion 23, along the generating line of the insert portion 24 and that of the truncated-cone portion 23. The main body nut 42 can be screw-engaged with the male screw 22 of the main body 20. Further, a tapered surface 43 formed along the interior circumferential surface of the main body nut 42 can be brought into surface contact with the truncated-cone portion 23 of the main body 20.

The main-body-diameter reducing mechanism 40 reduces the diameter of a small-diameter portion of the truncated-cone portion 23 while the width of the respective slit 41 is reduced, by causing the main body nut 42 to screw-engage with the male screw 22 of the main body 20 and bringing the tapered surface 43 into surface contact with the truncated-cone portion 23.

In short, the main-body-diameter reducing mechanism 40 enables a non-stepwise reduction in the diameter of the insert portion 24, by causing the main body nut 42 to screw-engage with the male screw portion 22 of the main body 20.

The engagement mechanism 50 comprises a cylindrical portion 52 joined to the main body nut 42 by way of a cone-shaped portion 51, a plurality of cylinder slits 53 formed in the cylindrical portion 52 so as to extend in the longitudinal direction thereof, a plurality of claws 54 formed along the interior peripheral surface of the cylindrical portion 52, and a cylinder nut 55 to be screw-engaged with a thread formed on the outer periphery of the main body nut 42.

The cylinder slits 53 and the cylinder nut 55 in combination serve as a cylinder-portion-diameter reducing mechanism for reducing the diameter of an open-end portion of the cylinder portion 52.

The cylindrical portion 52 has an internal diameter sufficient for receiving the outer peripheral surface of the insulating sheath 64 and a length to which the cylindrical portion 52 extends over the outer peripheral surface of the insulating sheath 64.

The outer diameter of the cone-shaped portion 51 is tapered toward the open end portion of the cylindrical portion 52 so as to match the outer diameter of a male screw formed on the outer peripheral surface of the main body nut 42 and the outer diameter of the cylindrical portion 52.

The cylinder slits 53 originate from positions along the circumference of the open end portion of the cylindrical portion 52, the positions being centered on the axis of the cylindrical portion 52 and spaced uniform intervals apart from one another in a circumferential direction. The slits 53 linearly extend from the positions to the large-diameter portion of the cone-shaped portion 51, along the generating line of the cylindrical portion 52 and that of the cone-shaped portion 51. The claws 54 are provided on the interior circumferential surface of the cylindrical portion 52 and at the respective open end portions of the same. The claw 54 assumes a substantially rectangular cross section and is tapered toward the open end portion.

The cylinder nut 55 can be screw-engaged with the male screw of the main body nut 42, and a tapered surface 56 formed along the interior circumferential surface of the cylinder nut 55 can be brought into surface contact with the cone-shaped portion 51 of the main body nut 42.

Such an engagement mechanism 50 is arranged such that a tapered surface 45 is brought into surface contact with and forcibly slidable contact with the cone-shaped portion 51 by the cylinder nut 55 being screw-engaged with the male screw of the main body nut 42, to thereby reduce the diameter of the open end portion of the cylindrical portion 52 while the width of each of the cylinder slits 53 is made smaller.

The engagement mechanism 50 can reduce the diameter of the open end portion of the cylindrical portion 52 in a stepless manner, by the cylinder nut 55 being screw-engaged with the male screw of the main body nut 42.

There will now be described procedures for connecting the end portion of the shielded wire 60 with the connector 10.

Figure 3:
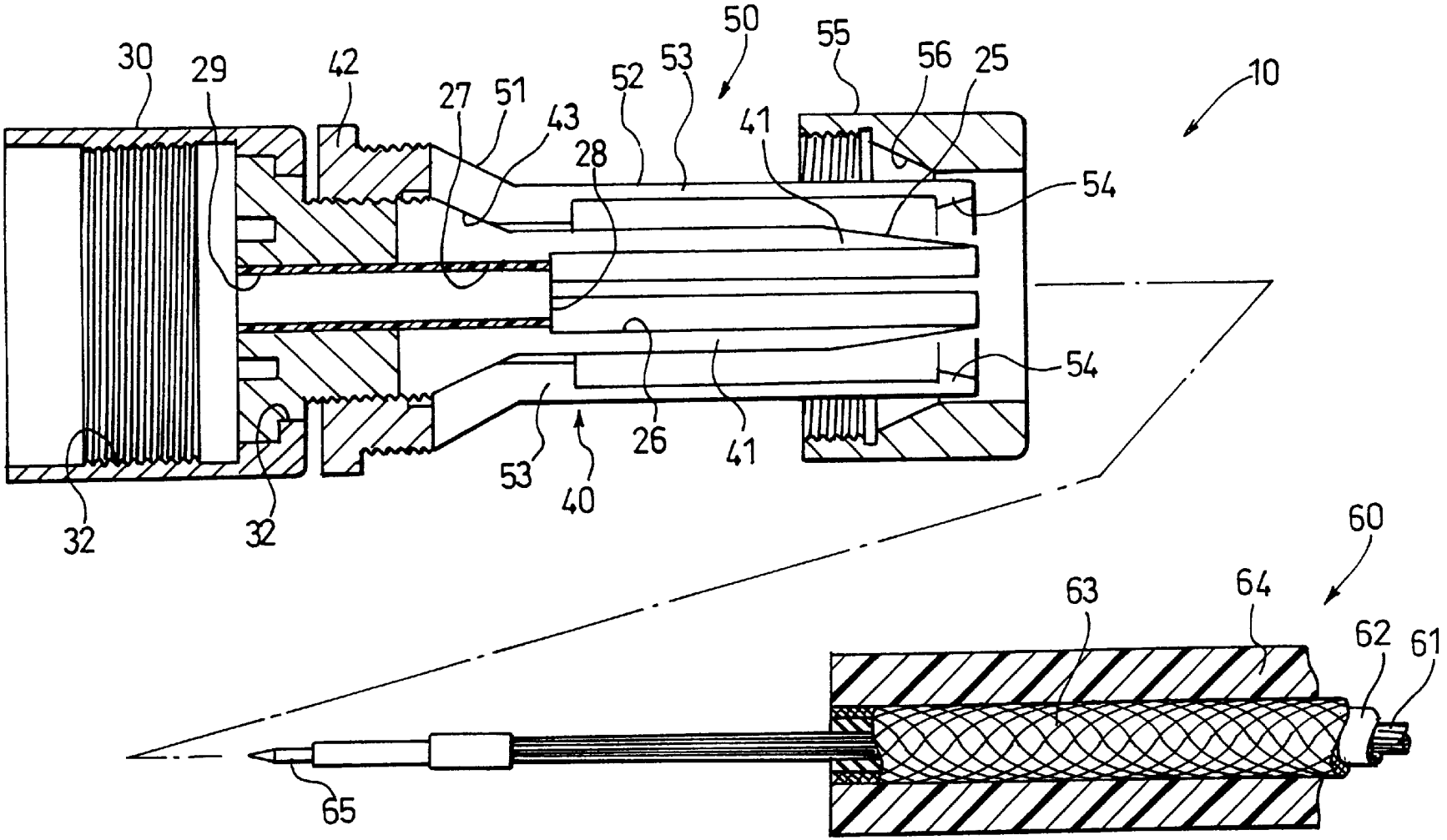
FIG. 3 is a cross-sectional view showing procedures for connecting the connector shown in FIG. 1 with a shielded wire.

As shown in FIG. 3, the insulating sheath 64, the braided conducting shield 63, and the insulating layer 62 are longitudinally exfoliated from the end portion of the shielded wire 60 to a predetermined location, to thereby make only the conductor 61 of predetermined length exposed. The center contact 65 is soldered to the end portion of the conductor 61. In the connector 10, the main body 20, the connection portion 30, the main body nut 42, and the cylindrical nut 55 are loosely connected together, so as to assume their initial shapes.

The conductor 61 is axially inserted into the insulating sleeve 29 fitted into the small-diameter portion 27 of the main body 20.

Since the insulating sleeve 29 is fitted into the small-diameter portion 27, the main body 20 is thoroughly insulated from the conductor 61.

Because of presence of the exterior tapered surface 25, the insert portion 24 assumes a cross section which is longitudinally tapered toward the leading end portion of the main body 20. Hence, the leading end portion of the insert portion 24 can readily enter a space defined between the braided conducting shield 63 and the insulating sheath 64 while compressively deforming the interior portion of the insulating sheath 64, thus minimizing the chance of breaking the end surface or circumferential surface of each of the braided conducting shield 63 and the insulating sheath 64.

The insert portion 24, in its present form, is inserted into the space between the braided conducting shield 63 and the insulating sheath 64, to thereby relatively move the open end portion of the cylindrical portion 52 to a predetermined position on the exterior surface of the insulating sheath 64.

At this time, so long as the end surface of the insulating layer 62 and the end surface of the braided conducting shield 63 are brought into contact with the stepped surface 28 formed on the interior surface of the main body 20, the relative position between the main body 20 and the shielded wire 60 can be limited.

The diameter of the insert portion 24 is reduced by firmly screw-engaging the main body nut 42 with the male screw 22 of the main body 20, to thereby hold the braided conducting shield 63.

Finally, the cylinder nut 55 is firmly screw-engaged with the male screw of the main body nut 42, to thereby reduce the diameter of the open end portion of the cylinder portion 52. Accordingly, the claws 54 formed on the interior surface of the cylinder portion 52 are engaged in the exterior surface of the insulating sheath 64. The position of the connector 10 relative to the end portion of the shielded wire 60 is fixed, to thereby complete the assembling operation.

In the connector 10 having the foregoing structure, the main body 20 inserted into the space between the braided conducting shield 63 and the insulating sheath 64 holds the braided conducting shield 63 while reducing the diameter of the braided conducting shield 63, wherewith the main body 20 is connected to the end portion of the shielded wire 60.

The connector 10 eliminates the necessity of complicated preliminary operations or re-assembly operations, which would have been required by the related connector 10. In contrast with the related connector, the connector 10 requires a smaller number of components which do not require a high degree of precision. Accordingly, the connector 10 can simplify the operations required for connecting the end portion of the shielded wire 60 to the connector much greater than those required for the related connector, thus reducing manufacturing costs.

In the connector 10, the main body nut 42 which is to be screw-engaged with the male screw 22 of the main body 20 by way of the truncated-cone portion 23 and the tapered surface 32 is employed as the main-body-diameter reducing mechanism 40. Accordingly, the connector 10 can be readily connected to the end portion of the braided conducting shield 63 through considerably simple operations and can reduce the diameter of the insert portion 24 in a stepless manner, thus offering versatility to braided conducting shields 63 of different diameters.

In the connector 10, the stepped surface 28 against which the end surface of the braided conducting shield 63 can abut is formed in the inside of the main body 20, and the insulating sleeve 29 is fitted around the small-diameter portion 27, thereby limiting the position of the connector 10 relative to the shielded wire 60 and insulating the main body 20 thoroughly from the conductor 61.

Further, in the connector 10, the cross-portion of the insert portion 24 is tapered toward the leading end portion of the main body 20, thereby enabling facilitated insertion of the insertion portion 24 into the space defined between the braided conducting shield 63 and the insulating sheath 64 and reducing the chance of the insert portion 24 damaging the end surface of the braided conducting shield 63 and that of the insulating sheath 64.

In the connector 10, since the cylinder portion 52 whose diameter can be reduced and which has the plurality of claws 54 is employed as the engagement mechanism 50 for causing the main body 20 to engage in the exterior circumferential surface of the insulating sheath 64. The diameter of the cylinder portion 52 is reduced, to thereby cause the claws 54 engage in the exterior circumferential surface of the insulating sheath 64. Consequently, the connector 10 can be connected with the end portion of the shielded wire 60 unfailingly.

Particularly, in such a shielded wire 10, the cylinder nut 55 which is screw-engaged with the main body nut 42 by way of the cone-shaped portion 51 and the tapered surface 56 is employed as the main-body-diameter reducing mechanism 40. Accordingly, the connector 10 can be readily connected to the end portion of the braided conducting shield 63 through considerably simple operations and can reduce the diameter of the insert portion 24 in a stepless manner, thus offering versatility to shielded wires 60 having insulating sheathes 64 of different diameters.

Figure 4A:
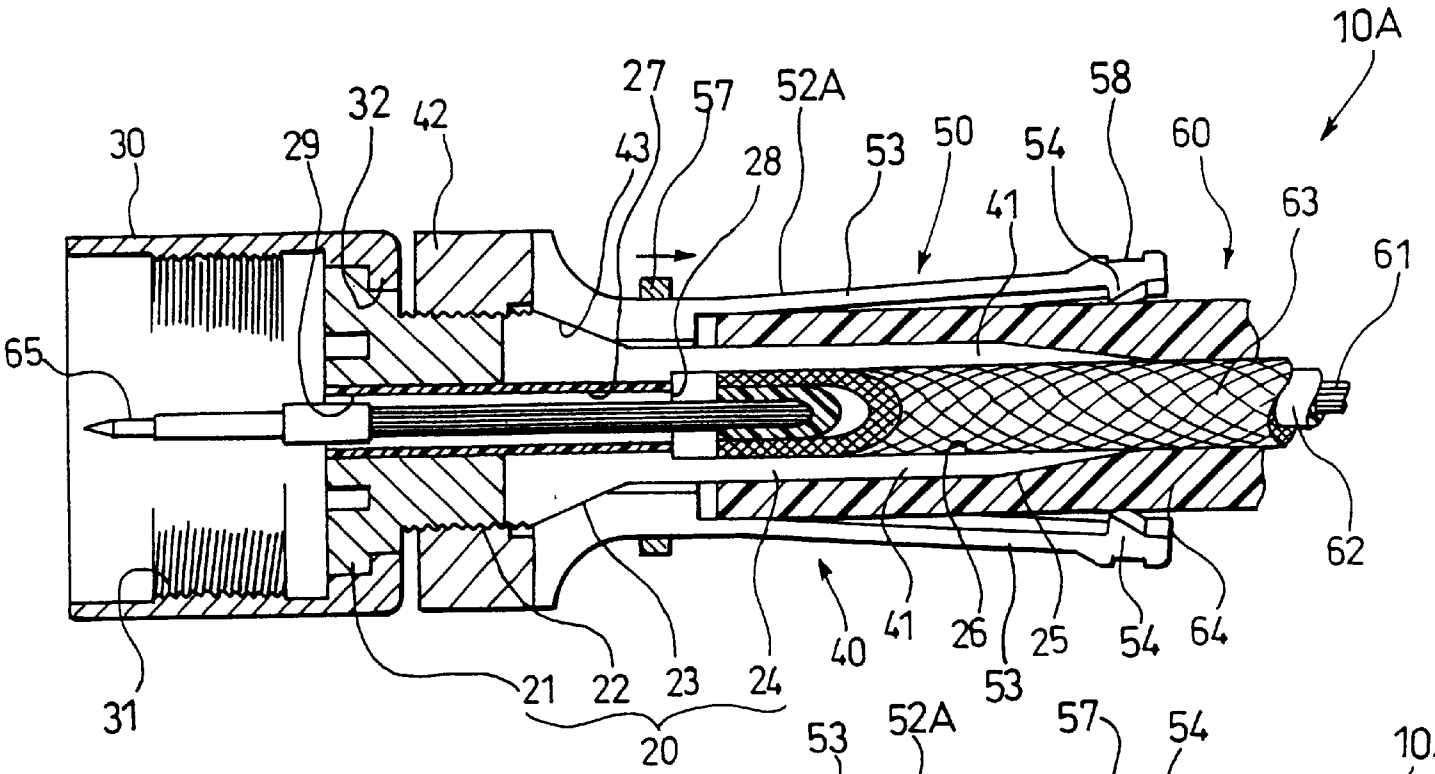
FIGS. 4A and 4B are cross-sectional views showing a connector according to a second embodiment of the present invention.
Figure 4B:
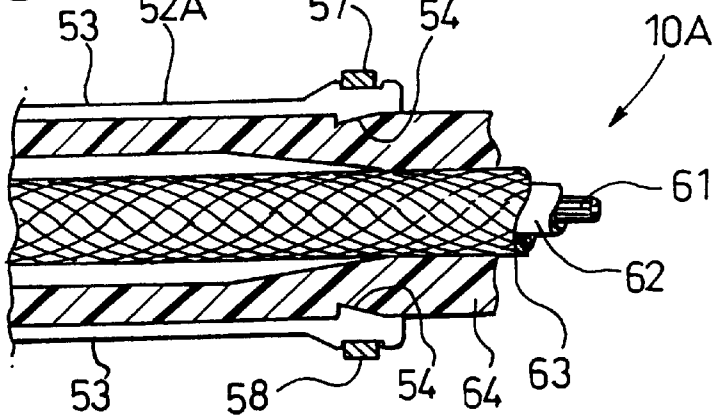
Figure 5:
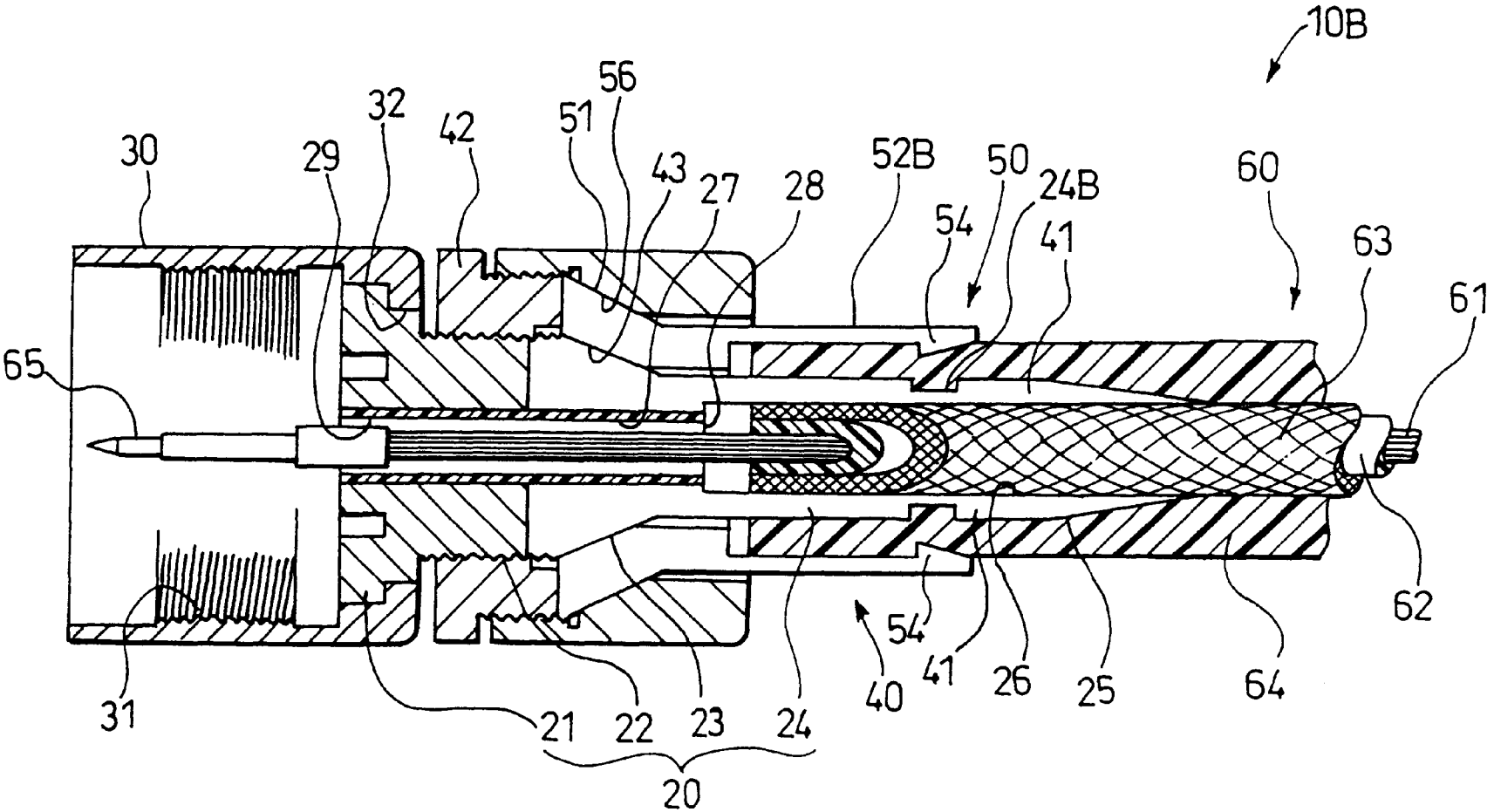
FIG. 5 is a cross-sectional view showing the principal portion of a connector according to a third embodiment of the present invention.

FIGS. 4A and 4B illustrate a connector 10A according to a second embodiment of the present invention, and FIG. 5 illustrates a connector 10B according to a third embodiment of the present invention.

In the embodiments to be described later, the components that have already been described in connection with FIGS. 1 through 3 are assigned the same or corresponding reference numerals, and repetition of their explanations is simplified or omitted.

The principal portion of the connector 10A shown in FIG. 4 is formed in the same manner as that of the connector 10 according to the first embodiment.

In the connector 10A, a cylinder portion 52A is formed so as to be wide open toward an open end portion thereof The connector 10A employs, as a main-body-diameter reducing mechanism, a ring member 57 loosely fitted around the cylinder portion 52A, and a groove 58 formed in the outer circumferential surface of the cylinder portion 52A and in the vicinity of the open end portion of the same.

In such a connector 10A, the ring member 57 is moved over the cylinder portion 52A in the longitudinal direction thereof until it is engaged with the groove 58, to thereby reduce the diameter of the open end portion of the cylinder portion 52A. The claws 54 are brought into engagement in the exterior circumferential surface of the insulating sheath 64.

The connector 10A yields the same advantage as that yielded by the connector 10 according to the first embodiment. As a result of the ring member 57 being moved over the cylinder portion 52A in its longitudinal direction, the diameter of the open end portion of the widely-open cylinder portion 52A is reduced directly and forcefully, thus bringing the claws 54 into unfailing engagement in the exterior surface of the insulating sheath 64. Thus, the connector 10A can be unfailing connected to the shielded wire 60.

A cylinder portion 52B of the connector 10B shown in FIG. 5 is longitudinally shorter than the cylinder portion 52 employed in the first embodiment and the cylinder portion 52A employed in the second embodiment. A groove 24B is formed at a position in the exterior circumferential surface of the insert portion 24, the position corresponding to the claws 54 of the cylinder portion 52B.

In the connector 10B, when the diameter of the cylinder portion 52B is reduced, so that the claws 54 are brought into engagement in the outer circumferential surface of the insulating sheath 64. The cross section of the insulating sheath 64 is partially deformed into a crank shape, for reasons of cooperative action effected by the claws 54 and the groove 24B.

Accordingly, the connector 10B can be connected to the shielded wire 60 more reliably than the connector 10 of the first embodiment and the connector 10A of the second embodiment.

The present invention is not limited to the previous embodiments and can be susceptible to modifications or improvements, so long as the present invention can be achieved. The materials, shapes, geometries, numbers, and locations of the elements of the present invention illustrated in connection with the previous embodiments, such as a conductor, an insulating layer, a braided conducting shield, an insulating sheath, a shielded wire, a main body, a connection portion, a main-body-diameter reducing mechanism, main body slits, a main body nut, a truncated-cone portion, a tapered surface, a large-diameter portion, a small-diameter portion, a stepped surface, an insulating sleeve, an engagement mechanism, a cylinder portion, claws, cylinder-portion-diameter reducing mechanism, cylinder slits, and a cylinder nut may changed, as necessary.

As has been described above, in the present invention, the diameter of a cylindrical main body which can be inserted into the space defined between a braided conducting shield and an insulating sheath is reduced. Hence, a connector according to the present invention eliminates the necessity of complicated preliminary operations or re-assembly operations, which would have been required by the related connector. In contrast with the related connector, the connector of the present invention requires a smaller number of components which do not require a high degree of precision. Accordingly, the connector of the present invention can simplify the operations required for connecting the end portion of a shielded wire to the braided-shield connector much greater than those required for the related connector, thus reducing manufacturing costs.

According to the present invention, a main body and a main body nut, which are brought into contact with each other by way of a truncated-cone portion and a tapered surface are employed as a main-body-diameter reducing mechanism. Accordingly, the connector can be readily connected to the end portion of the braided conducting shield through considerably simple operations; that is, screw-engagement of the main body nut with the main body. Further, the braided conducting shield can readily hold the main body, thereby enabling connection of the connector with the end portion of the shielded wire and offering versatility to braided conducting shields of different diameters.

In the present invention, the end surface of the braided conducting shield can abut against a stepped surface, thereby limiting the position of the main body relative to the shielded wire. Since the insulating sleeve is fitted around the small-diameter portion, the conductor can be unfailingly insulated from the main body.

Further, the cross-portion of the main body is tapered toward the leading end portion thereof, thereby enabling facilitated insertion of the main body into the space defined between the braided conducting shield and the insulating sheath. As a result, an operation for connecting the main body with the shielded wire can be facilitated, thereby reducing the chance of the insert portion damaging the end surface of the braided conducting shield and that of the insulating sheath.

In the present invention, since the diameter of the cylinder portion is reduced by the main-body-diameter reducing mechanism, the claws provided on the cylinder portion are engaged in the exterior circumferential surface of the insulating sheath while the position of the main body relative to the insulating sheath is maintained, thereby enabling reliable connection of the main body with the shielded wire by way of the cylinder portion and the main body nut.

Accordingly, the main body can be readily and unfailingly connected to the braided conducting shield through considerably simple operations; that is, screw-engagement of the nut of the cylinder portion with the main body nut. The diameter of the main body can be reduced in a stepless manner by screw-engagement of the cylinder portion nut with the main body nut, thus offering versatility to braided conducting shields having insulating sheathes of different diameters.

What is claimed is:

1. A connector connectable to an end portion of a shielded wire which includes a conductor, an insulating layer coating the conductor, a braided conducting shield covering the insulating layer, and an insulating sheath covering the braided conducting shield, the connector allowing axial insertion of the conductor of the shielded wire while insulating the conductor, said connector comprising:

a cylindrical main body wherein in an engaged position, said main body is inserted between the braided conducting shield and the insulating sheath in a longitudinal direction of the shielded wire so as to electrically connect said cylindrical main body to the braided conducting shield;

a connection portion provided at a base end portion of the main body in an inserting direction in which the main body is inserted between the braided conducting shield and the insulating sheath; and a main-body-diameter reducing mechanism which reduces a diameter of a leading end portion of the main body in the inserting direction thereof.

2. The connector of claim 1, wherein the main-body-diameter reducing mechanism includes at least one main body slit formed in the main body so as to extend from the leading end portion of the main body to a predetermined position in a longitudinal direction of the main body, and a main body nut screw-engaged with an exterior surface of the main body, and wherein the main body and the main body nut are brought into contact with each other by way of either a truncated-cone surface or a tapered surface which is tapered in a vicinity of an end portion of the main body slit toward the leading end portion of the main body in the inserting direction thereof.

3. The connector of claim 1, wherein an interior circumferential surface of the main body is formed into a stepped geometry including a large-diameter portion and a small-diameter portion, wherein in an engaged position an end surface of the braided conducting shield operable abuts against a stepped surface between the large-diameter portion and the small-diameter portion, and an insulating sleeve is fitted around the small-diameter portion.

4. The connector of claim 1, wherein the main body has a cross section longitudinally tapered toward the leading end portion of the main body in the inserting direction thereof.

5. The connector of claim 1, wherein the main-body-diameter reducing mechanism axially-encloses the main body.

6. The connector of claim 1, further comprising an engagement mechanism for causing the main body to engage in an exterior circumferential surface of the insulating sheath, wherein the engagement mechanism includes:

a cylinder portion which is connected to a main body nut and extends along the exterior circumferential surface of the insulating sheath, a claw formed on an interior circumferential surface of the cylinder portion at an open end portion of the cylinder portion, and a cylinder-portion-diameter reducing mechanism which reduces a diameter of the open end portion of the cylinder portion.

7. The connector of claim 6, wherein the cylinder-portion-diameter reducing mechanism includes a cylinder slit formed in the cylinder portion so as to extend in a longitudinal direction thereof, and a cylinder nut to be screw-engaged with an outside of the main body nut, wherein the main body and the main body nut are brought into contact with each other by way of either a truncated-cone surface or a tapered surface, which is tapered in a vicinity of an end portion of the main body slit toward the leading end portion of the main body in the inserting direction thereof.

* * * * *